US006942456B2

(12) United States Patent
Shapiro

(10) Patent No.: US 6,942,456 B2
(45) Date of Patent: Sep. 13, 2005

(54) HOME COMFORT APPLIANCE

(75) Inventor: Barry Shapiro, Doylestown, PA (US)

(73) Assignee: Lasko Holdings, Inc., Wilmington, DE (US)

( * ) Notice: Subject to any disclaimer, the term of this patent is extended or adjusted under 35 U.S.C. 154(b) by 81 days.

(21) Appl. No.: 10/431,964

(22) Filed: May 8, 2003

(65) Prior Publication Data

US 2004/0120816 A1 Jun. 24, 2004

Related U.S. Application Data

(63) Continuation-in-part of application No. 10/347,079, filed on Jan. 17, 2003, which is a continuation-in-part of application No. 10/322,169, filed on Dec. 18, 2002, now Pat. No. 6,760,543.

(51) Int. Cl.[7] ..... F04D 29/00

(52) U.S. Cl. ..... 416/100; 416/246

(58) Field of Search ..... 416/98, 100, 148, 416/205, 246; 415/203, 204, 206, 211.1, 211.2, 198.1

(56) References Cited

U.S. PATENT DOCUMENTS

| | | | | |
|---|---|---|---|---|
| 1,429,130 A | | 9/1922 | Dutton | |
| 2,181,628 A | * | 11/1939 | Shawhan | 415/208.1 |
| 2,255,759 A | | 9/1941 | Carpenter | |
| 2,471,784 A | | 5/1949 | Seifner et al. | |
| 2,824,429 A | | 2/1958 | Zucker | |
| 3,175,550 A | | 3/1965 | Knapp | |
| 3,251,540 A | | 5/1966 | Kinsworthy | |
| 3,267,255 A | | 8/1966 | Schultz | |
| 3,290,112 A | | 12/1966 | Gillenwater et al. | |
| 3,575,582 A | | 4/1971 | Covault | |
| 3,725,640 A | | 4/1973 | Kunz | |
| 3,874,191 A | * | 4/1975 | Hudson | 415/206 |
| 4,450,755 A | * | 5/1984 | Catan | 415/206 |
| 4,743,739 A | | 5/1988 | Tateishi | |
| 4,856,968 A | * | 8/1989 | Armbruster | 415/126 |
| 4,900,898 A | | 2/1990 | Kling | |
| 5,083,011 A | | 1/1992 | Munroe | |
| 5,266,004 A | * | 11/1993 | Tsumurai et al. | 416/100 |
| 6,079,949 A | | 6/2000 | Litvin | |
| 6,321,034 B2 | | 11/2001 | Jones-Lawlor et al. | |
| RE37,642 E | | 4/2002 | Goldstein | |
| 6,480,672 B1 | | 11/2002 | Rosenzweig et al. | |

FOREIGN PATENT DOCUMENTS

| | | |
|---|---|---|
| DE | 863 112 C | 1/1953 |
| EP | 0 417 309 A1 | 3/1991 |
| FR | 993168 | 10/1951 |
| FR | 1502108 A | 11/1967 |

* cited by examiner

*Primary Examiner*—Edward K. Look
*Assistant Examiner*—Richard A. Edgar
(74) *Attorney, Agent, or Firm*—Woodcock Washburn LLP

(57) ABSTRACT

The present invention is a home comfort appliance comprising a housing and an air generator. A support member having a predetermined diameter B and a predetermined rise height R provides support and elevation to the housing. The housing is either fixedly or rotatably coupled to an end of the support member and comprises at least one wall portion having a predetermined length L and an air generation envelope D, at least one inlet opening formed in a first portion of the at least one wall portion, at least one outlet opening formed in a second portion of the at least one wall portion, and an air generator positioned between the at least one inlet opening and the at least one outlet opening. The air generator provides exhaust air to the at least one outlet opening.

66 Claims, 15 Drawing Sheets

HOME COMFORT APPLIANCE

This application is a Continuation-in-Part of application Ser. No. 10/347,079, filed Jan. 17, 2003, which is a Continuation-in-Part of application Ser. No. 10/322,169, filed Dec. 18, 2002 now U.S. Pat No. 6,760,543.

FIELD OF THE INVENTION

This invention relates to home comfort appliances. More specifically, the present invention relates to a space saving pedestal fan.

BACKGROUND OF THE INVENTION

Pedestal Fans of various sizes have been used for many years. The normal use of a pedestal fan is to provide a cooling sensation to the body. This is accomplished by the current of air generated by the fan or air-moving device passing over the skin of an individual. The current of air that passes over an individual serves to increase the convective heat loss of the body through the natural evaporative process of moisture (sweat) on the skin. The greater the amount of evaporation the greater the sensation of cooling. The upper portion of the body is more exposed, (head, arms, hands, etc.). This allows the upper portion of the body to experience a greater cooling sensation as the body attempts to naturally dissipate heat through evaporation.

As shown in FIG. 1, the conventional pedestal fan 10 is specifically designed to augment this effect by locating the air generation device at a level above the floor that corresponds to the upper portion of the body. In pedestal fan 10, air 12 is created by axial fan assembly 14 (comprising fan head 16, fan blade 18, front grill 20 and rear grill 22). Axial fan assembly 14 is set above the floor by pedestal 24 and stabilized by large base 28 such that air 12 can be positioned above the floor to provide comfort to the upper portion of user 26.

The size of the air delivery device (axial fan assembly 14) in conventional pedestal fan 10 is very large due to the diameter of axial blade 18, further requiring additional large guards (grills) 20, 22, to protect user 26 from blade 18. In addition, and as shown in FIGS. 2A–2C, conventional pedestal fan 10 requires significant area for oscillation 29, at least as large, if not larger, than the diameter of the grills 20, 22, so that the cooling effect can be distributed into the living space (not shown). In addition, because of the size and weight distribution of fan assembly 14, base 28 must be sufficiently large to support fan assembly 14 to prevent tipping.

Another fan that attempts to augment this upper body cooling effect is what is commonly referred to as a tower fan. As shown in FIGS. 3A–3B, tower fans 30, 40 create an elongated air delivery area 32, 42 toward a lower portion of user 26 and, thus, are unable to provide a desired cooling effect to the user.

In addition to the aforementioned deficiencies, pedestal fan 10 requires a significant amount of packaging material as well as space for shipment to the ultimate destination. As shown in FIG. 4A, conventional pedestal fan 10 is shipped to the user in a disassembled form in shipping box 50. Typically, shipping box 50 is stacked with many other shipping boxes 50 on pallets 52 (shown in FIG. 5B) with multiple pallets 52 shipped together in an overland or over water shipping container 54. Due to its large size, and the requirement of retailers that product be provided on skids for easy handling, the number of units of fan 10 that may be stacked on skid 52 is about 48 units. Further, due to this low skid yield, the number of pedestal fans 10 that may be contained within shipping container 54 is about 864.

The packaging of Tower fan 40 is illustrated in FIG. 4B. Similar to package 50, package 56 containing tower fan 40 has a significant volume, albeit slightly less than that of pedestal fan 10. FIGS. 6A–6B illustrate the shipping efficiency of this configuration with a typical skid 52 having a capacity of 44 units and shipping container 54 having a capacity of 1320 units.

Thus, the costs for shipping of these fan units impact the ultimate price at which a manufacturer may sell his product to a distributor or retailer.

In view of these deficiencies, there is a need for a fan that has a space saving configuration and provides comfort to an upper portion of a user's body.

In addition, there is a need for a fan construction which is easily packaged and shipped in a manner that reduces shipping and handling costs per unit.

SUMMARY OF THE INVENTION

In view of the shortcomings of the prior art, the present invention is a home comfort appliance. The home comfort appliance comprises a housing, an air generator and a support member. The support member provides support and elevation, and has a predetermined diameter B and a predetermined rise height R. The housing is either fixedly or rotatably coupled to an end of the support member and comprises at least one wall portion having a predetermined length L and an air generation envelope D, at least one inlet opening formed in a first portion of the at least one wall portion, at least one outlet opening formed in a second portion of the at least one wall portion, and an air generator positioned between the at least one inlet opening and the at least one outlet opening. The air generator provides exhaust air to the at least one outlet opening.

According to another aspect of the invention, the support member comprises a base and a columnar riser.

According to a further aspect of the invention, the housing further comprises at least one of: i) control means for controlling operation of the home comfort appliance, and ii) oscillation means for oscillating the housing with resect to the support member.

According to still another aspect of the invention, the support further comprises a coupling disposed between a lower portion of the housing and an upper portion of the support, the coupling having a diameter larger than a diameter of the support.

According to yet a further aspect of the present invention, the air generation envelope D is i) less than the diameter B and ii) between 10% to 90% of length L, and wherein the rise height R is greater than 39% of length L.

According to yet another aspect of the present invention, the length L is less than 68% of the sum of the length L plus the rise height R.

According to still another aspect of the present invention, the rise height R is greater than 29% of the sum of length L plus the rise height R.

According to a further aspect of the present invention, the air generator comprises a motor having a shaft and a blade assembly coupled to the shaft, the blade assembly having an overall length no greater than 45% of an overall length of the home comfort appliance.

According to yet a further aspect of the present invention, an oscillation means or rotation means is disposed at a lower portion of the housing and coupled between the housing and the support member.

According to yet another aspect of the present invention, the air generator further comprises a blade assembly, the blade assembly positioned behind the at least one outlet opening by a predetermined distance greater than 20% of a diameter of the blade assembly.

According to still another aspect of the invention, the air generator comprises a motor having a shaft, a plurality of blade assemblies with at least one of the plurality of blade assemblies coupled to the shaft. The plurality of blade assemblies spaced apart from one another by a predetermined distance, each of the plurality of blade assemblies comprising a pair of impeller portions formed as a unitary member, and at least one bearing assembly disposed at least one of i) between a pair of the plurality of blade assemblies and ii) adjacent an end one of the plurality of blade assemblies.

According to yet another aspect of the invention, the air generator comprises a motor having a shaft extending from opposite sides of the motor and a pair of blade assemblies each coupled to respective portions of the shaft, each blade assembly having no greater than two impeller portions formed as a unit and coupled to the respective portion of the shaft.

According to yet a further aspect of the invention, at least a portion of the exhaust air travels along a path substantially orthogonal to a longitudinal axis of the housing.

According to still a further aspect of the invention, the home comfort appliance is portable.

According to yet another aspect of the invention, the home comfort appliance comprises means for at least one of i) positioning the housing at one of a plurality of rotational positions, ii) oscillating the housing between a first position and a second position, and iii) rotating the housing about a longitudinal axis.

According to still a further aspect of the invention, the air generator is a blower assembly.

According to still another aspect of the invention, the fan further comprises redirecting means for redirecting the exhaust air flowing from the outlet opening.

According to a further aspect of the invention, the housing is substantially linear.

According to still another aspect of the invention, the home comfort appliance further comprises at least one louver adjacent the at least one outlet opening for redirecting the exhaust air flowing from the outlet opening.

According to yet a further aspect of the invention, a height of the housing above a mounting surface is adjustable to one of a plurality of positions.

According to another aspect of the invention, the housing has either a substantially circular, substantially oval or substantially polygonal cross-section.

According to still another aspect of the invention, the base has either a substantially circular, substantially oval or substantially polygonal cross-section.

These and other aspects of the invention are set forth below with reference to the drawings and the description of exemplary embodiments of the invention.

BRIEF DESCRIPTION OF THE DRAWINGS

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following Figures.

DETAILED DESCRIPTION

The entirety of the disclosures of U.S. patent application Ser. No. 10/322,169, filed Dec. 18, 2002, and U.S. patent application Ser. No. 10/347,079, filed Jan. 17, 2003 are expressly incorporated by reference herein.

Figure 7C:
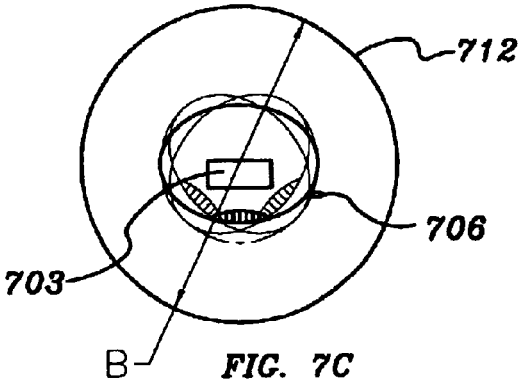
FIGS. 7A–8C are various illustrations of exemplary embodiment of the present invention.
Figure 7A:
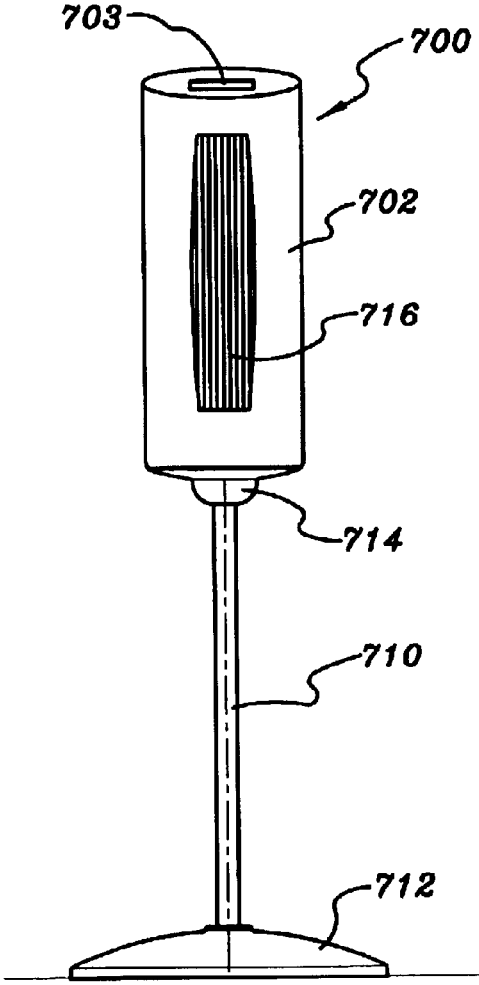
Figure 7B:
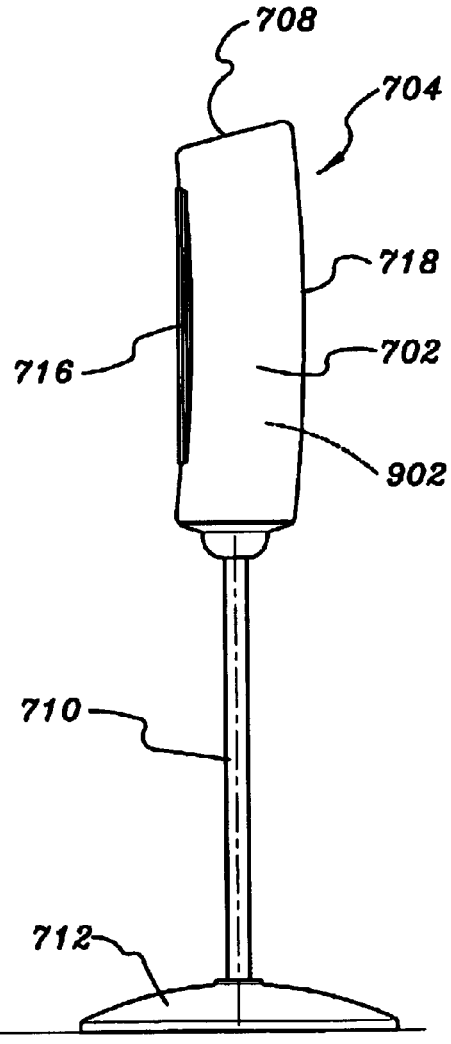
Figure 8A:
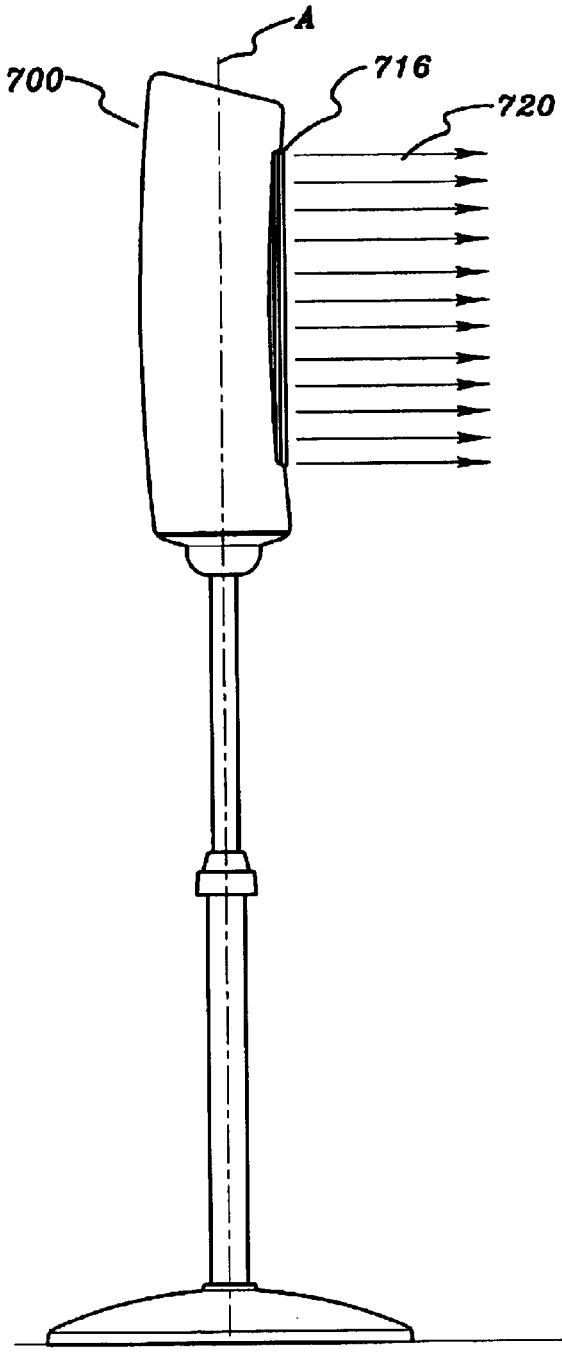
Figure 8B:
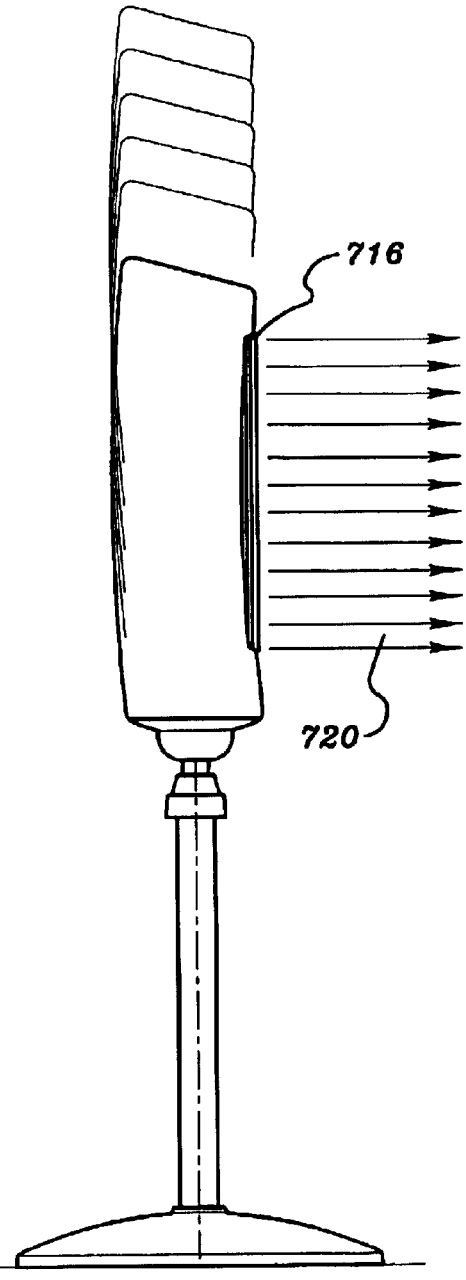

A first exemplary embodiment of the present invention is illustrated in FIGS. 7A–7C. As shown in FIGS. 7A–7C, home comfort appliance 700 has a generally elongate configuration and includes housing 702, having a substantially linear configuration and at least one wall 704 with a length L (best shown in FIG. 13A) less than 30 inches, and defining an air generation envelope 706. Support column 710 is connected to a lower portion of housing 702. In turn, base 712 (comprising of one or multiple pieces attached to one another) having a diameter B is coupled to the lower portion of support column 710. The combination of base 712 and column 710 defines a rise height R (best shown in FIG. 13A). In one exemplary embodiment, rise height R is at least 12 inches and may be adjustable as desired (as shown in FIGS. 8A and 8B). Further, length L may be between about 15 and 30 inches while the overall length from the floor to top 708 of home comfort appliance 700 may be at least 45 inches, an alternatively between about 45 to 60 inches. Due to its size, home comfort appliance 700 may be easily transported from place to place with a living space or between various living spaces as desired.

Figure 8C:
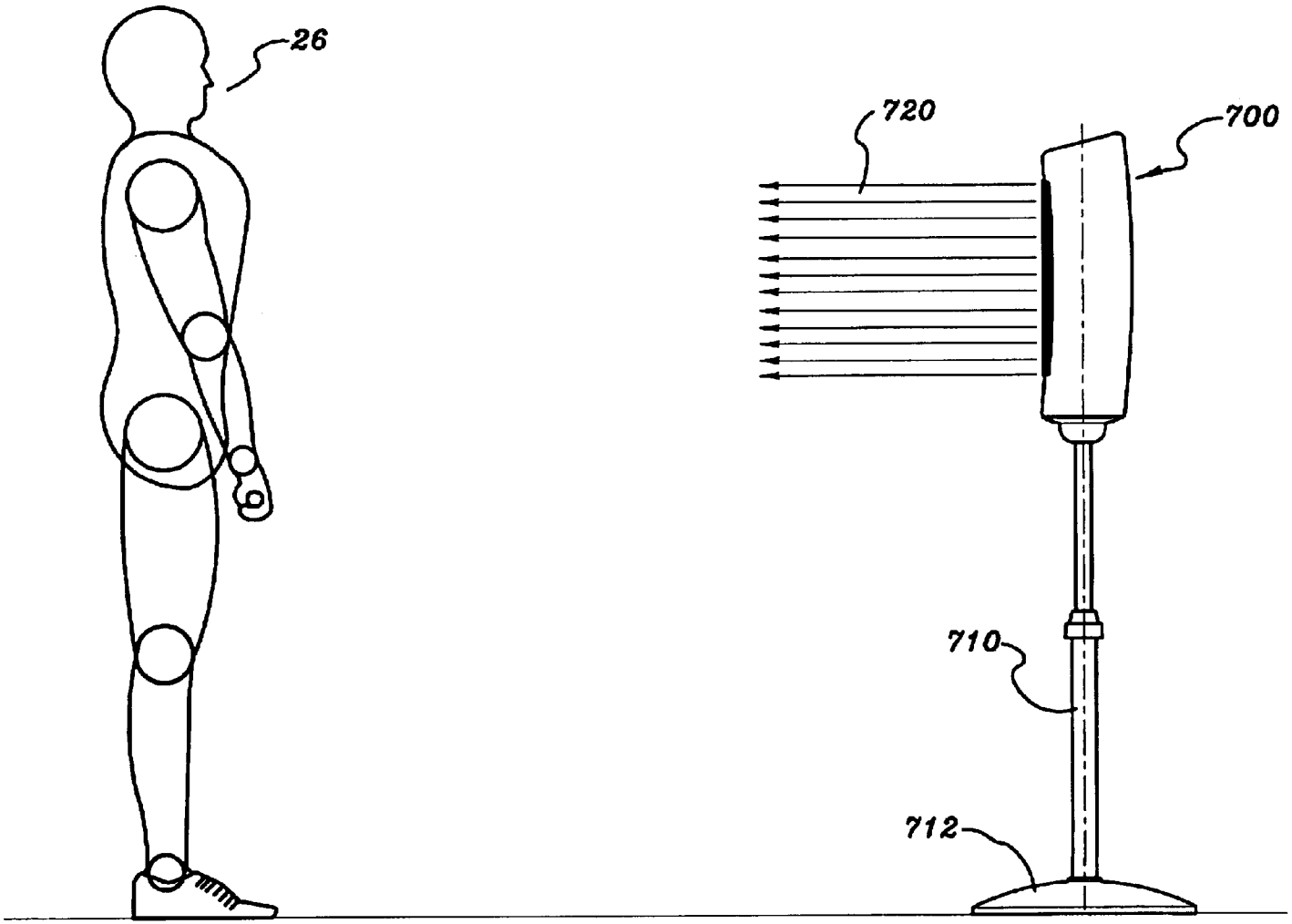

As shown in FIG. 7C, home comfort appliance 700 has a significantly reduced air generation envelope 706 as compared to the prior art pedestal fans while providing cooling air 720 to an upper portion of user 26 (best shown in FIG. 8C).

Referring again to FIGS. 7A–7C, although the exemplary embodiment illustrates base 712 and column 710 as separate pieces, the invention is not so limited. It is contemplated that the support of housing 702 may be accomplished in a variety of ways, such as forming column 710 and base 712 as a unitary member having a predetermined shape. One non-limiting example of such a shape is a conical shape for example.

Housing 702 also includes at least one outlet opening 716 formed in a front portion of housing 702, and at least one inlet opening 718 preferably formed in a portion of housing 702 rearward of outlet 716. Outlet opening 716 may include a grill and/or louvers (either fixed or moveable), for example. Examples of positions for inlet opening 718 are in a rear portion of housing 702 and/or a side portion of housing 702. Air generator 902 (best shown in FIG. 9A) is positioned within housing 702 and between inlet 718 and outlet 716. Air generator 902 (shown in FIG. 9A) receives air from inlet 718 and generates cooling air 720 (best shown in FIGS. 8A and 8B) for output through outlet 716 such that output air 720 travels along a path substantially orthogonal to the longitudinal axis A of housing 702. Home comfort appliance 700 may also include a controller, such as control assembly 703 mounted for example on an upper portion and/or front portion of housing 702 for controlling fan speed, rotation, oscillation, etc. Alternatively, control of home comfort appliance 700 may be accomplished by a remote control unit (not shown) in conjunction with or as a replacement for control assembly 703.

In one exemplary embodiment, housing 702 may be coupled directly to column 710 such that housing 702 is fixed with respect to column 710. In another embodiment, an intermediate coupling 714 having a diameter larger than that of column 710 may be used to couple housing 702 to column 710. Such a coupling 714 may be used with either the fixed or rotatable/moveable embodiments described above and below.

In one exemplary embodiment, housing 702 rotates with respect to support column 710. Such rotation may be accomplished either in an oscillatory fashion (over a range of up to about 360 degrees), a stepwise positioning of housing 702 (either manually of under automated control), or in a constant rotation, either in a clockwise or counter-clockwise direction. To accomplish automatic oscillation or rotation of housing 702, oscillation means, such as a motor and drive assembly 900, coupled between housing 702 and support column 710. Alternately, oscillation means 900 may be located below housing 702 and coupled between housing 702 and support column 710.

As shown in FIGS. 7A–7C, air generation envelope 706 is less than the diameter B of base 712. Further, in one exemplary embodiment of the present invention, air generation envelope 706 may also be between 10% to 90% of length L, and the rise height R is greater than 39% of length L. In an alternate embodiment, length L is less than 68% of the sum of length L plus rise height R, or rise height R is greater than 29% of the sum of length L plus rise height R.

The configuration of the wall 704 may be such that the housing has a substantially round cross section, for example. The invention is not so limited, however, in that the wall 704 may be more than one wall coupled to one another and/or having any of a variety of geometric cross sections, such as a square, an oval, a rectangle, or other polygonal forms. In one exemplary embodiment, wall 704 may be formed from any material that is rigid or self-supporting, such as a polymer for example.

Figure 9B:
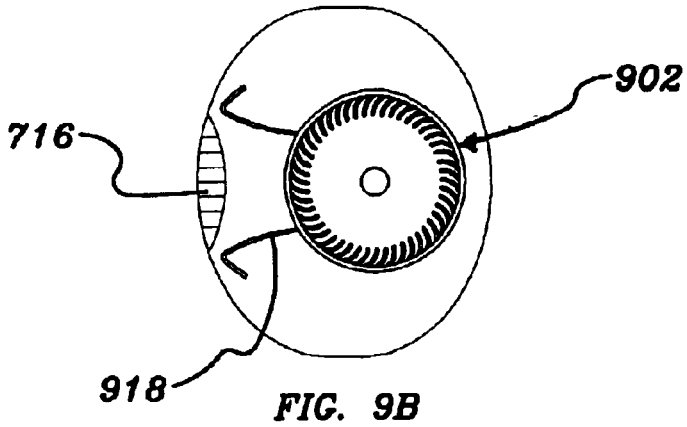
FIGS. 9A–9B are various cross-sectional views of an exemplary embodiment of the present invention.
Figure 9A:
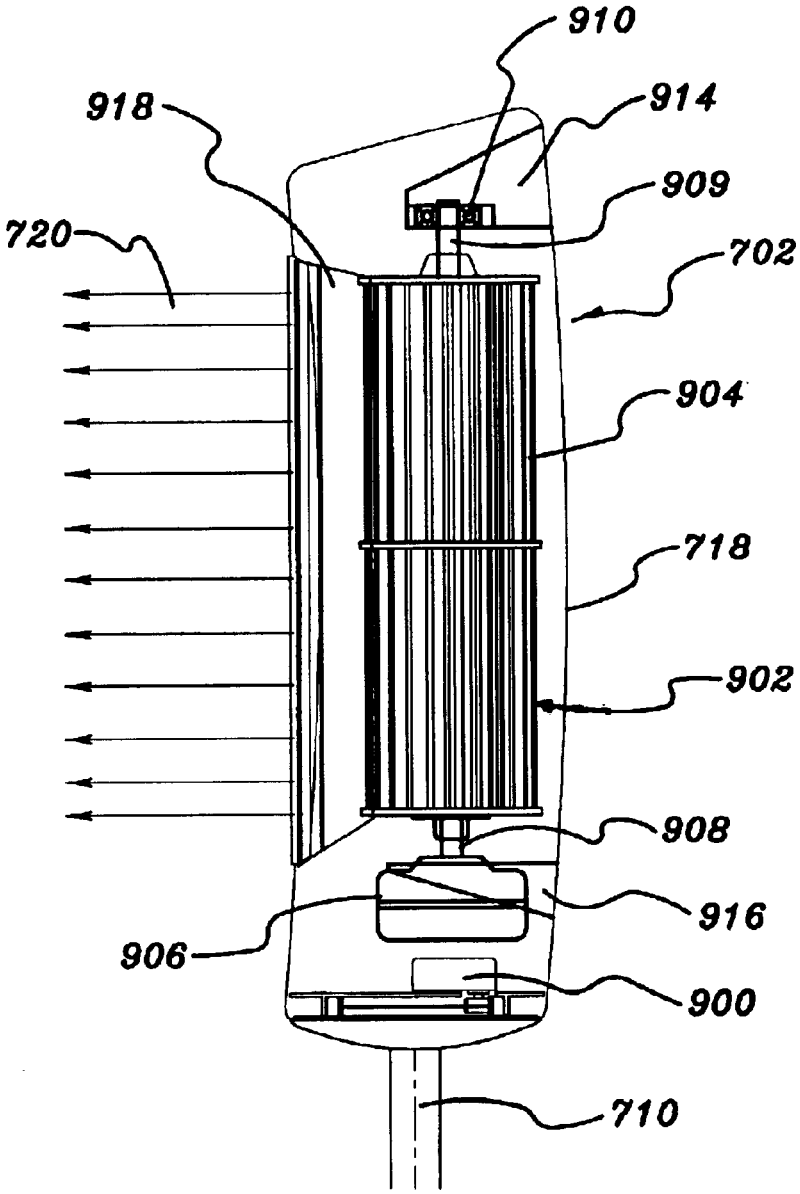

As illustrated in FIGS. 9A and 9B, in one exemplary embodiment, transverse air generator 902 is positioned within housing 702. Air generator 902 receives a supply of air through at least one inlet port 718 in housing 702. Air generator 902 comprises motor 906 having shaft 908 coupled to at least one of the upper end or lower end of blade assembly 904. Motor 906 is supported by lower support member 916, for example, which is in turn attached to housing 702. An upper shaft 909 terminates at remote bearing 910 which is in turn attached to housing 702 by upper support bracket 914. Upper shaft 909 may be an extension of shaft 908 or may be a separate shaft coupled to an upper portion of blade assembly 904, for example. In one exemplary embodiment, blade assembly 904 has an overall length no greater than 45% of an overall length OAL of home comfort appliance 700 (best seen in FIG. 13A). This has the advantage of minimizing, if not eliminating, manufacturing problems associated with conventional designs in that, by having a short blade assembly 904 with respect to overall length OAL, alignment problems between adjacent portions of the blade assembly are avoided. Further, alignment of the blade assembly with the motor shaft is more precise resulting in a reduction in impeller noise due to blade imbalance between the motor and blade and/or between portions of the assembled blade. Additionally, the exemplary design allows for the use of a lower power motor due at least in part to the reduction of the length of blade assembly 904, thereby reducing mass and rotational resistance.

In one exemplary embodiment, blade assembly 904 is positioned behind outlet 716 by a distance greater than about 20% of the diameter of blade assembly 904. This also provides an advantage over the prior art in that blade assembly 904 is more concealed than in conventional pedestal fans such that it is more difficult for foreign objects to penetrate the grill and reach the impeller or blade of air generator 906.

The output of air generator 902 is coupled to air guide 918 which acts to direct exhaust air from air generator 902 to outlet 716. In one exemplary embodiment, air guide 918 also acts as a cut-off to prevent air from entering air generator 902 other than through inlet port 718. Here too the length of exemplary blade assembly 904 provides an advantage over prior art designs, in that alignment of blade assembly 904 with air guide 918 is more precise; thus, maximizing the volume and speed of cooling exhaust air 720 generated by home comfort appliance 700.

In one exemplary embodiment, exhaust air 720 flows along a path that is substantially perpendicular to the longitudinal axis of housing 702.

Figure 10B:
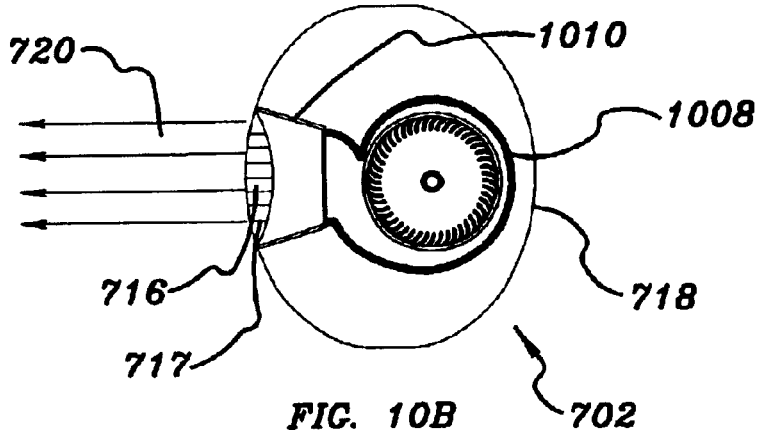
FIGS. 10A–10B are various cross-sectional views of a second exemplary embodiment of the present invention.
Figure 10A:
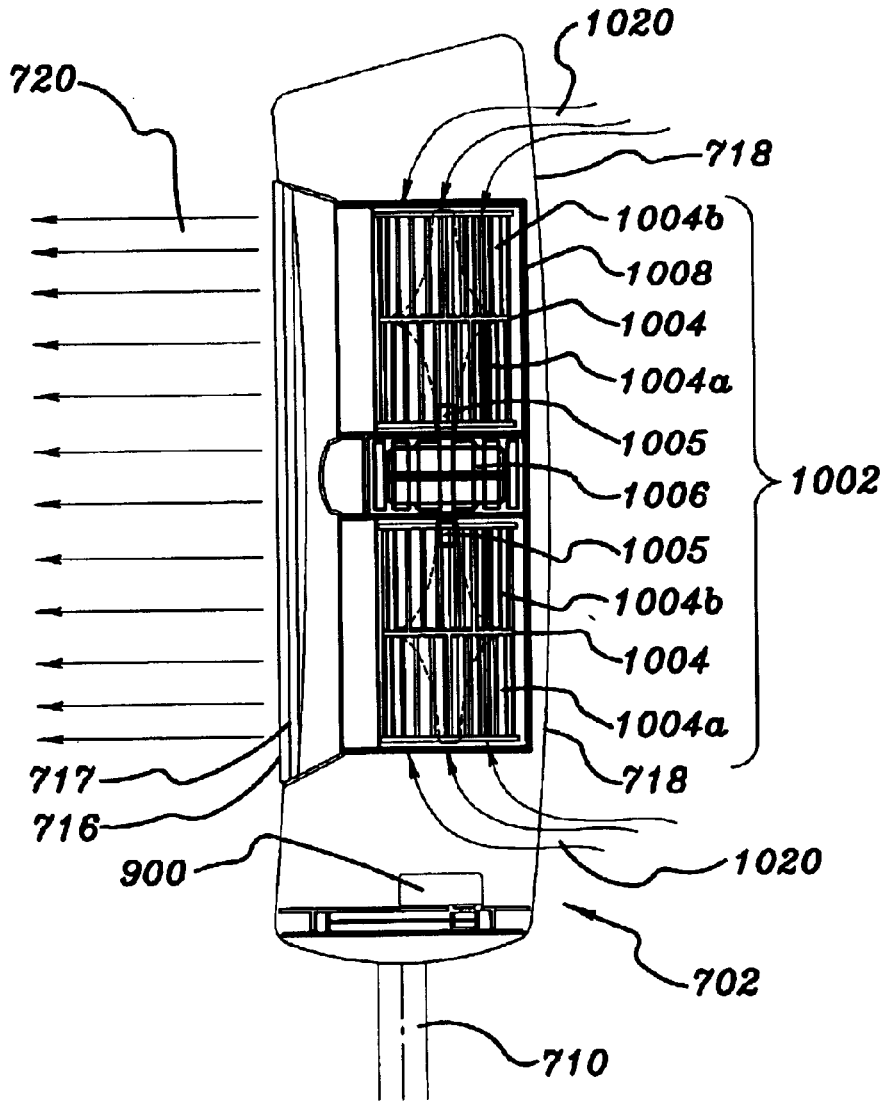

Referring now to FIGS. 10A–10B, in an another exemplary embodiment, air generation unit 1002 is preferably a unitary assembly and comprises motor 1006 disposed between impellers 1004, each of which are coupled to motor 1006 at shafts 1005 extending from opposite sides of motor 1006, all of which is disposed within housing 1008. In one embodiment of the invention, impeller 1004 is comprises of at least one, but no more than two sections 1004*a*, 1004*b* formed as a unitary part. By forming impeller 1004 as a unitary part, greater tolerances may be achieved, thus minimizing vibration and attendant operational noise in assembly 1002 as well as maximizing output from air generator 1002 by minimizing the entry of air into the exhaust section of the air generator.

As shown in FIG. 10A, in one exemplary embodiment inlet air 1020 enters through inlet 718 in housing 702 and enters an end portion of air generation assembly 1002. Cooling air 720 traveling in a path substantially orthogonal to inlet air 1020 is channeled to outlet 716 by concentrator 1010 which is disposed between the outlet of air generator assembly 1002 and outlet 716. Alternatively, inlet air 1020 can enter through inlet 718 in housing 702 and in turn enters a rear portion of air generation assembly 1002.

Outlet 716 comprises grill 717 coupled to housing 702. In one exemplary embodiment grill 717 comprises substantially parallel louvers. The louvers may be stationary or moveable in either or both vertical and horizontal directions, as desired. In all other respects, this exemplary embodiment is similar to the exemplary embodiment of FIGS. 9A–9B.

Figure 11B:
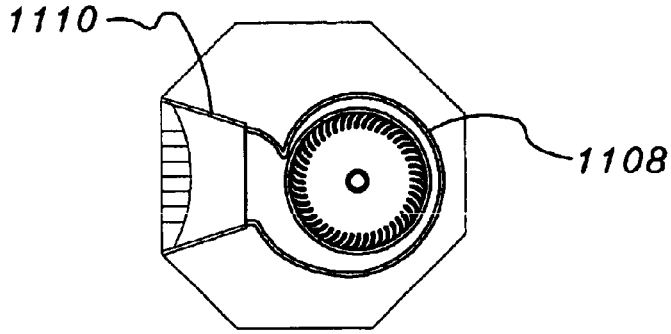
FIGS. 11A–11B are various cross-sectional views of a third exemplary embodiment of the present invention.
Figure 11A:
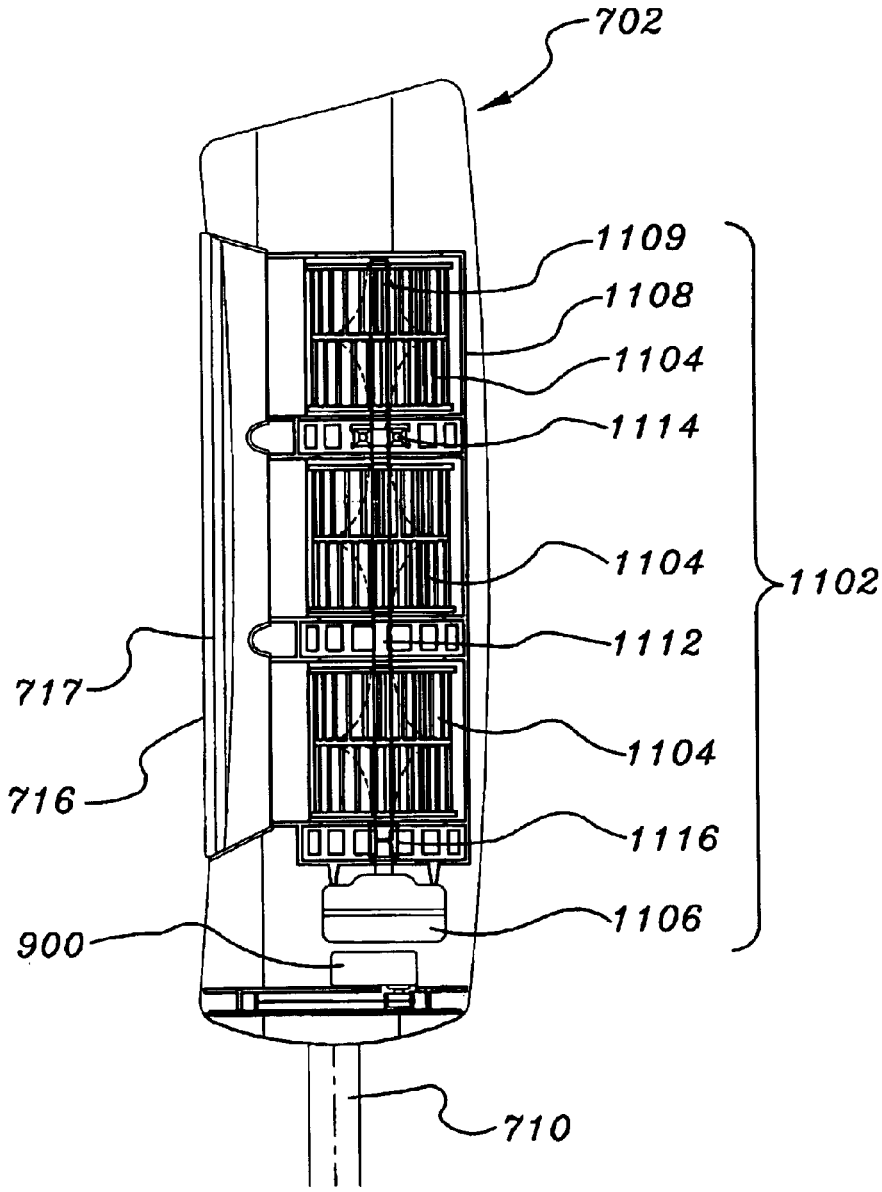
Figure 12B:
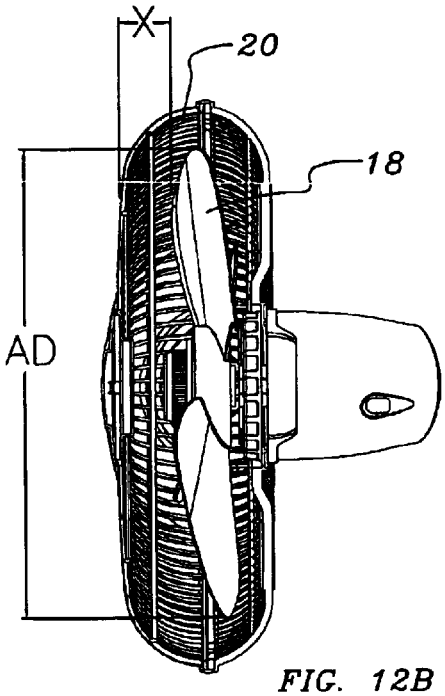
FIG. 12B PRIOR ART
FIGS. 12A–12D are various cross-sectional views comparing a conventional pedestal fan to an exemplary embodiment of the present invention.
Figure 12D:
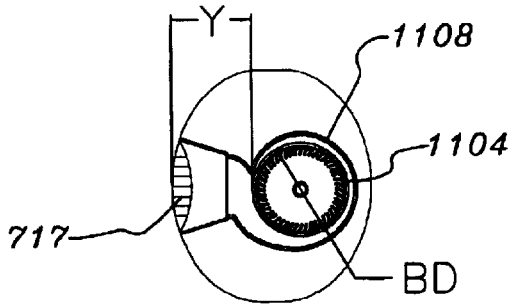
Figure 12A:
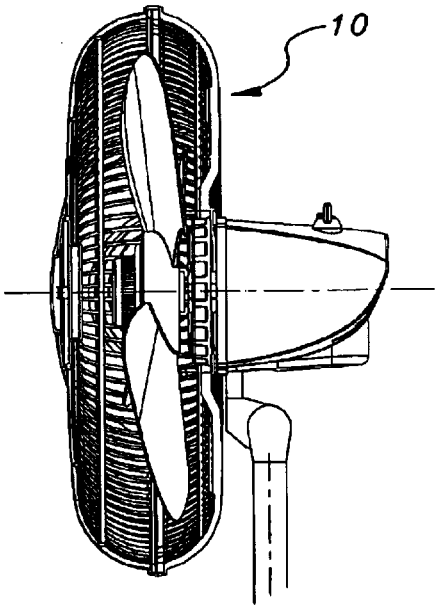
FIG. 12A PRIOR ART
Figure 12C:
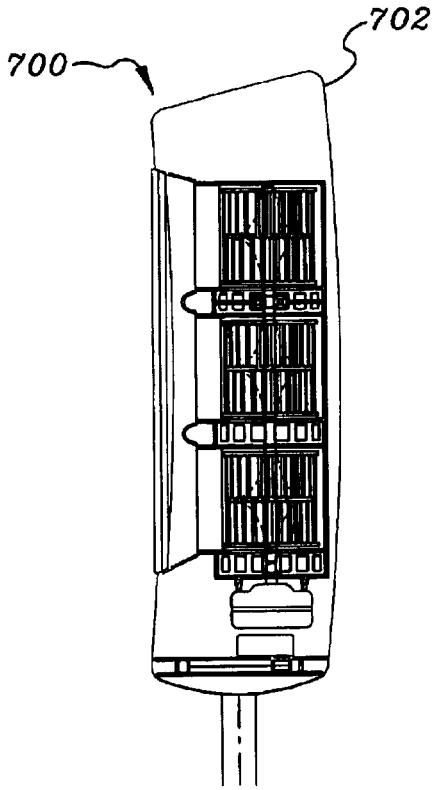

Referring now to FIGS. 11A–11B, in yet another exemplary embodiment, air generator 1102 is preferably a unitary assembly and comprises motor 1106 having shaft 1109 coupled to blade assemblies (impellers) 1104. An upper portion of shaft 1109 is coupled at remote bearing 1114 which is disposed between adjacent blade assemblies 1104. In one embodiment, impellers 1104 are comprised of at least one, but no more than two sections formed as a unitary part. Each impeller 1104 is coupled to shaft 1009 at least one of an upper portion, central portion, and/or lower portion of impeller 1104. In all other respects this exemplary embodiment is similar to the exemplary embodiment of FIGS. 9A–9B.

Referring now to FIGS. 12A–12D, a comparison of a conventional pedestal fan to an exemplary embodiment of the present invention is illustrated. In conventional fan 10, set back distance X between axial blade 18 and front grill 20 is between 5% to 15% of axial blade 18 diameter AD. By sharp contrast, in the embodiment of FIGS. 12C–12D, set back distance Y between the leading edge of impeller 1104 and front grill 717 is at least 20% of diameter BD of impeller 1104. Thus, in the exemplary embodiment, impeller 1104 is more concealed than axial fan blade 18 in the conventional pedestal fan, thereby providing an additional advantage in that it is more difficult for foreign objects to penetrate the grill and reach the impeller or blade of the air generator.

Figure 13B:
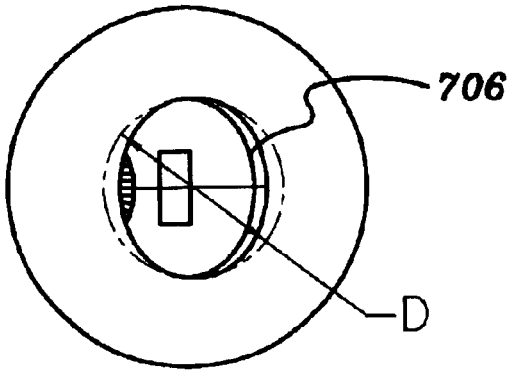
FIGS. 13A–13B are various views of an exemplary embodiment of the present invention illustrating various dimensional relationships of the cooperating elements.
Figure 13A:
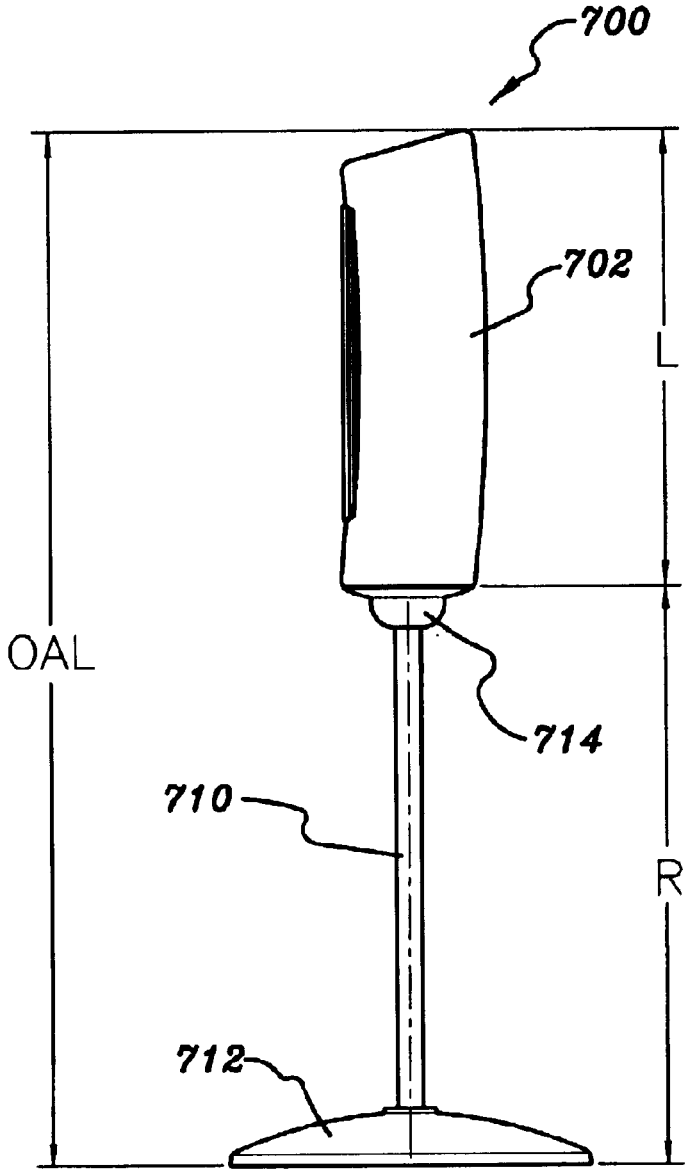

Referring now to FIGS. 13A–13B, various dimensional relationships of the present invention as illustrated. As shown, diameter D of air generation envelope 706 is between 10% and 90% of length L of housing 702. Rise height R is at least 39% of length L, and preferably between 39% to 400% of length L. In addition, Rise height R is greater than 290% of overall length OAL of home comfort appliance 700 and preferably between 29% and 80% of overall length OAL. Length L of housing 702 is less than 68% of overall length OAL and preferably between 20% and 68% of overall length OAL.

Figure 1:
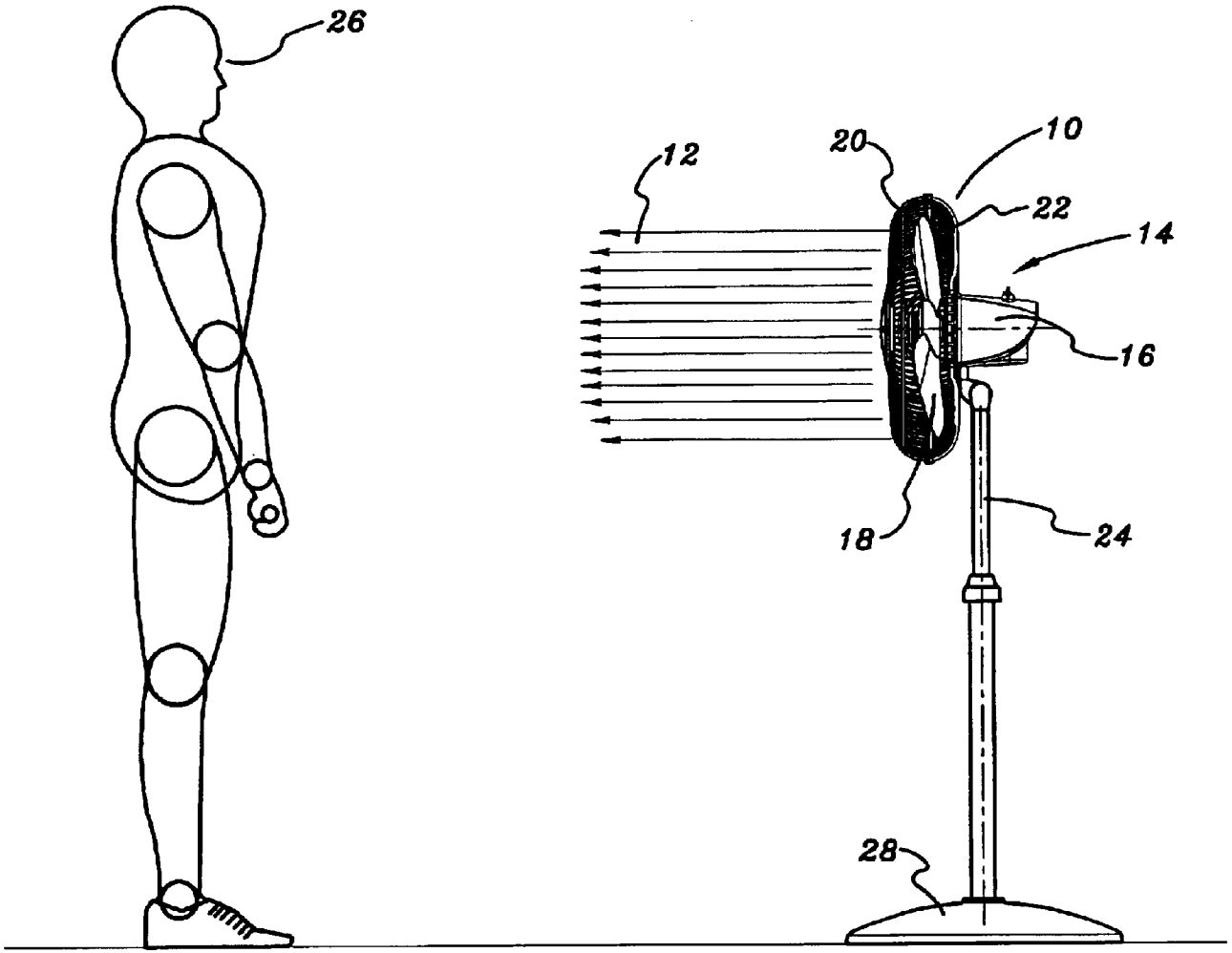
FIG. 1 PRIOR ART
FIG. 1 is an illustration of a conventional pedestal fan.
Figure 2C:
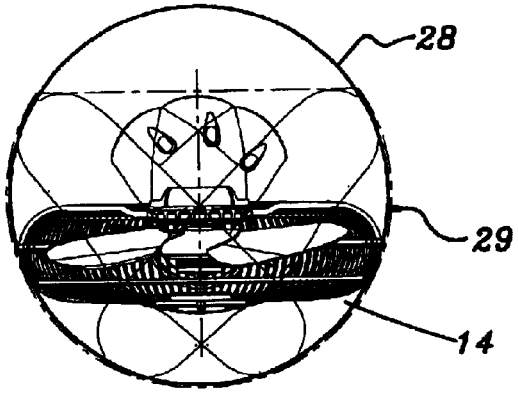
FIGS. 2A–2C are various views of the conventional pedestal fan of FIG. 1.
Figure 2A:
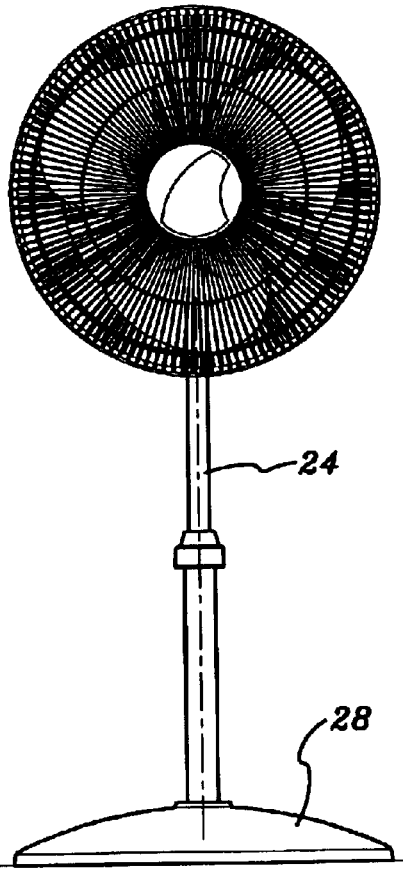
Figure 2B:
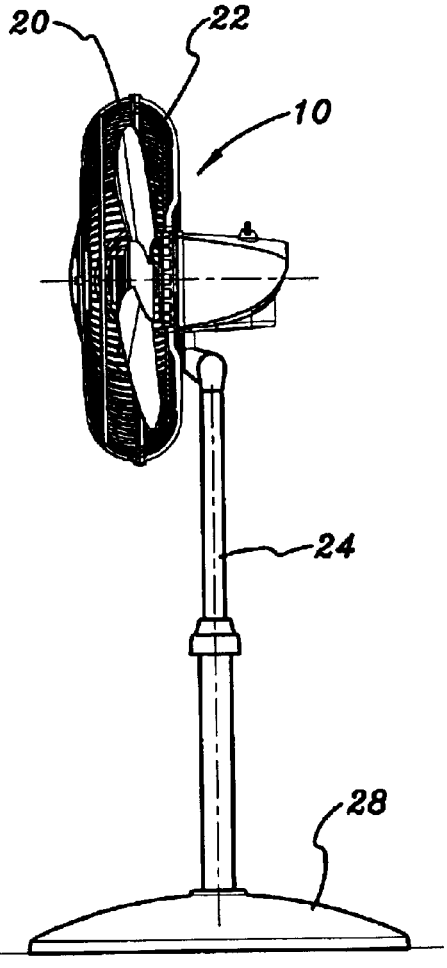
FIG. 2B PRIOR ART
Figures 3A, 3B:
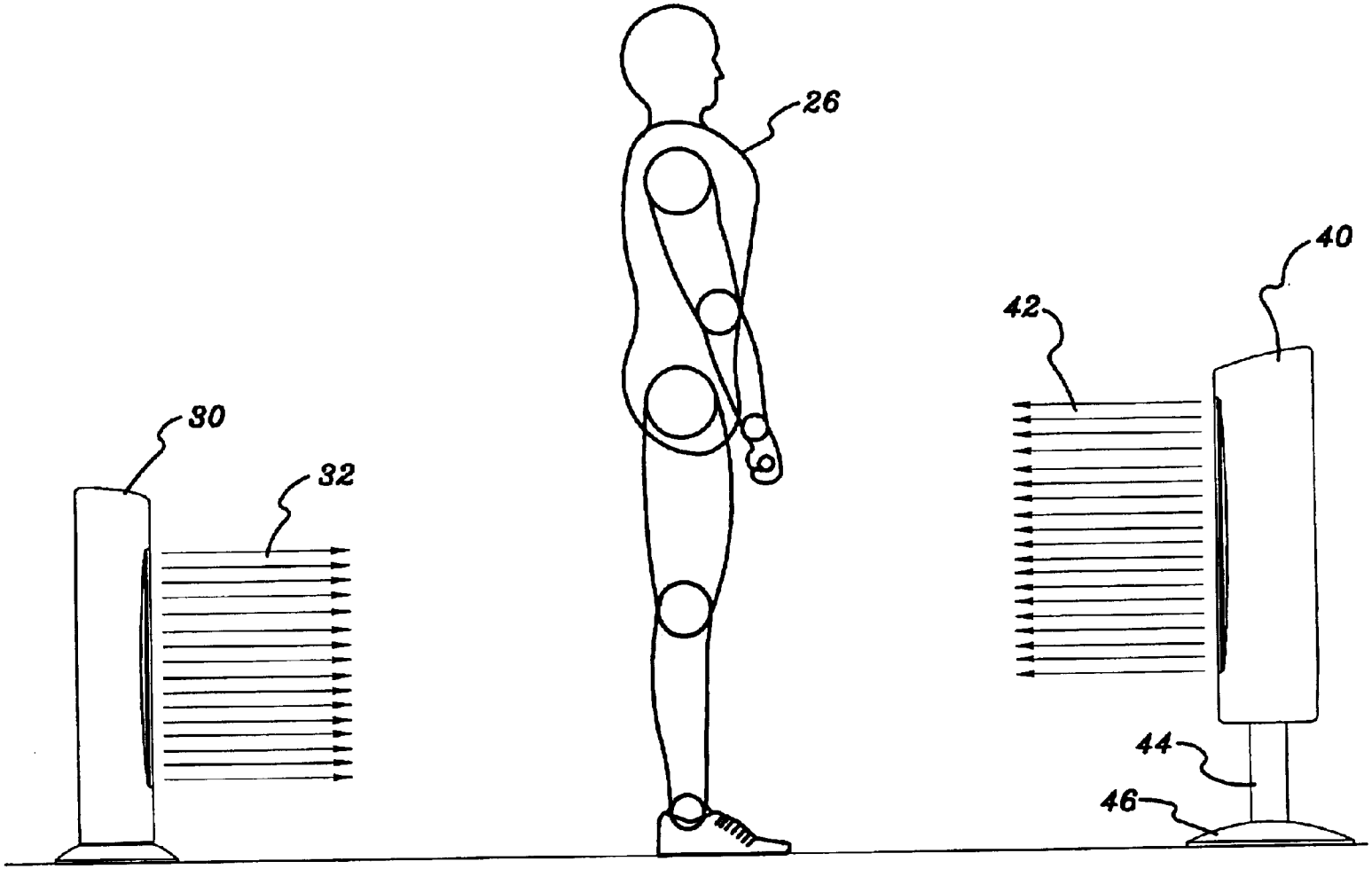
FIG. 3B PRIOR ART
FIG. 3A PRIOR ART
FIGS. 3A–3B are views of various conventional floor fans.
Figure 4C:
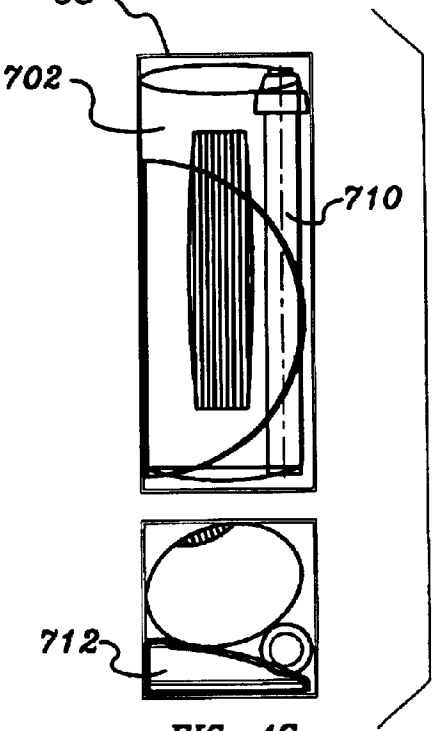
FIGS. 4A–4C are comparative views of packaging according to an exemplary embodiment of the present invention to the packaging of conventional fans.
Figure 4B:
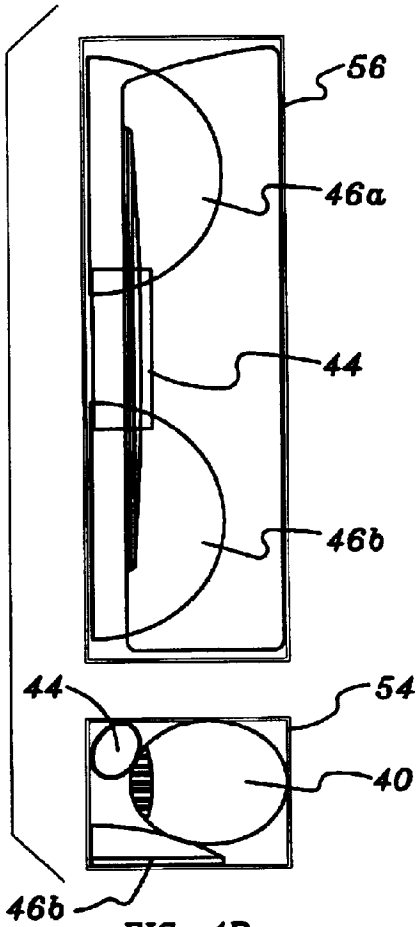
FIG. 4B PRIOR ART
Figure 4A:
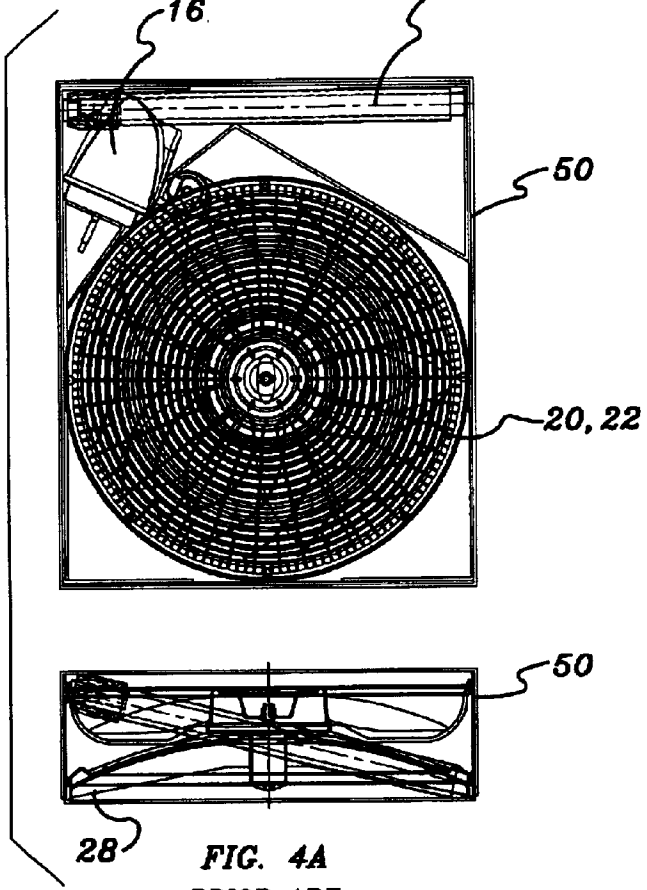
FIG. 4A PRIOR ART
Figure 5B:
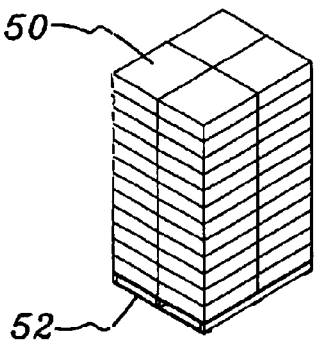
FIG. 5B PRIOR ART
FIGS. 5A–6B are various views of palletizing and transporting conventional fans.
Figure 5A:
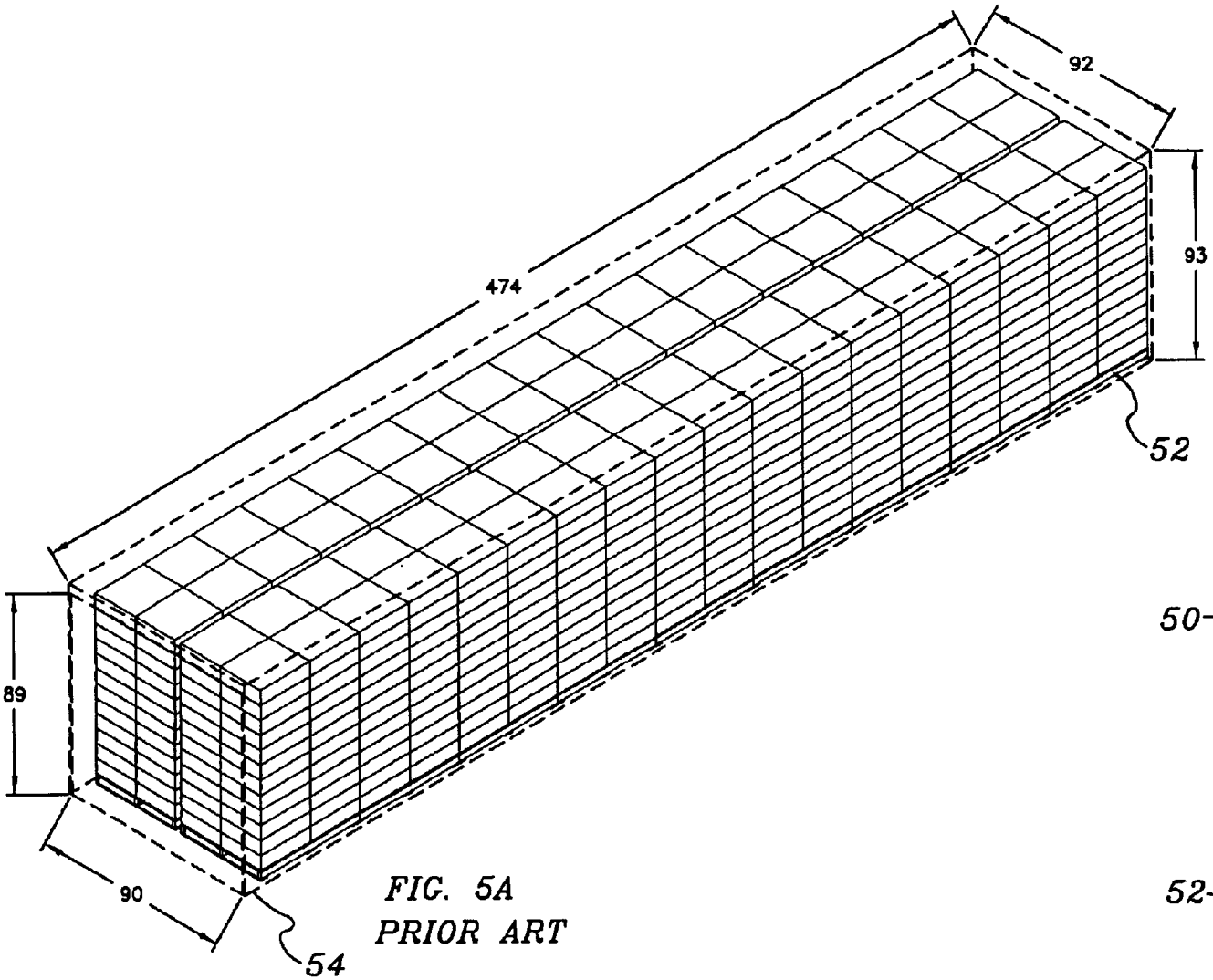
FIG. 5A PRIOR ART
Figure 6A:
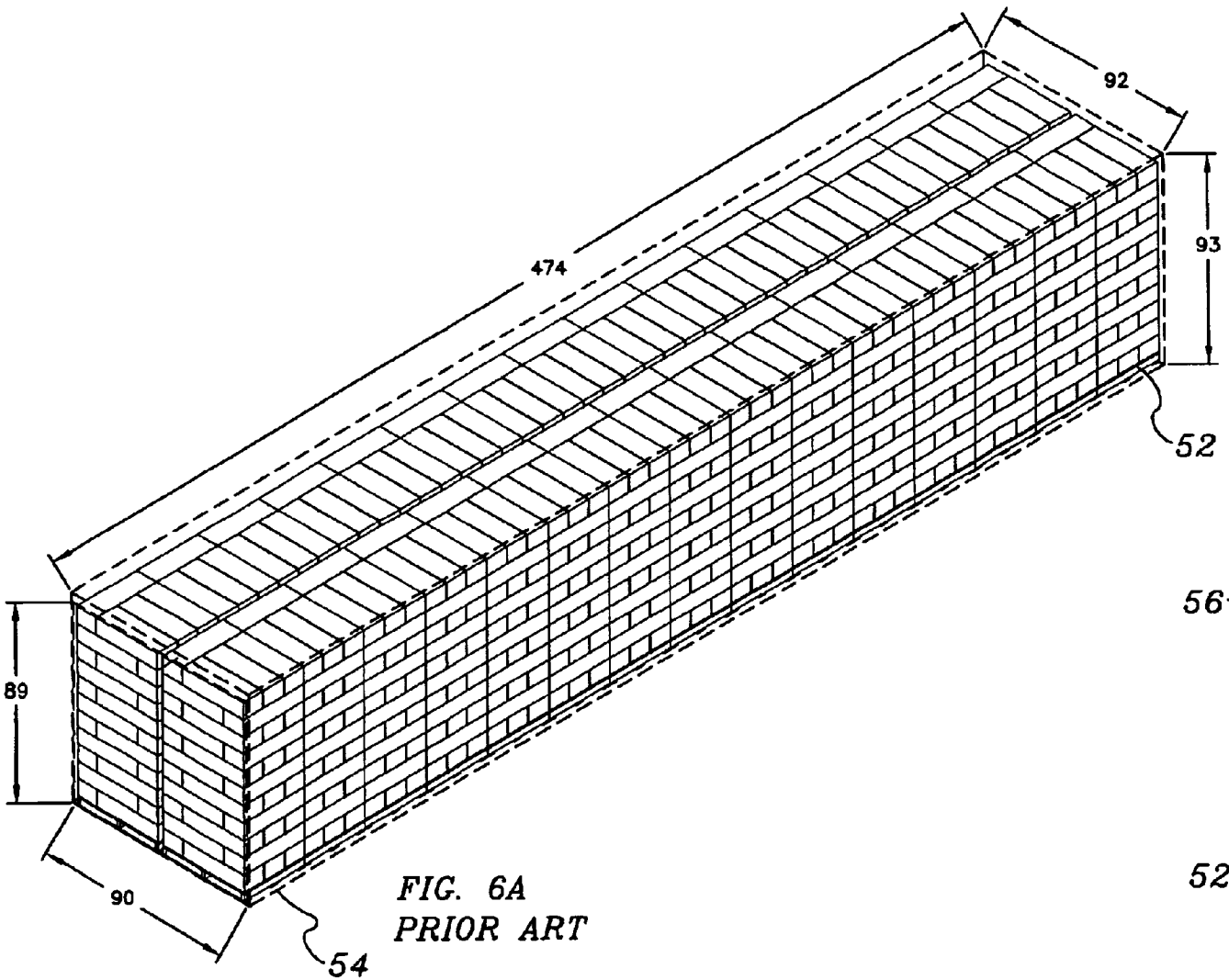
FIG. 6A PRIOR ART
Figure 6B:
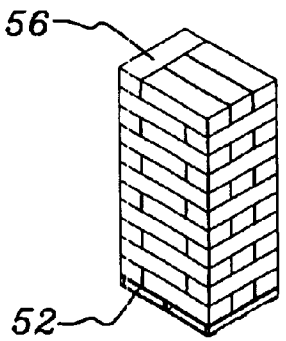
FIG. 6B PRIOR ART
Figure 14A:
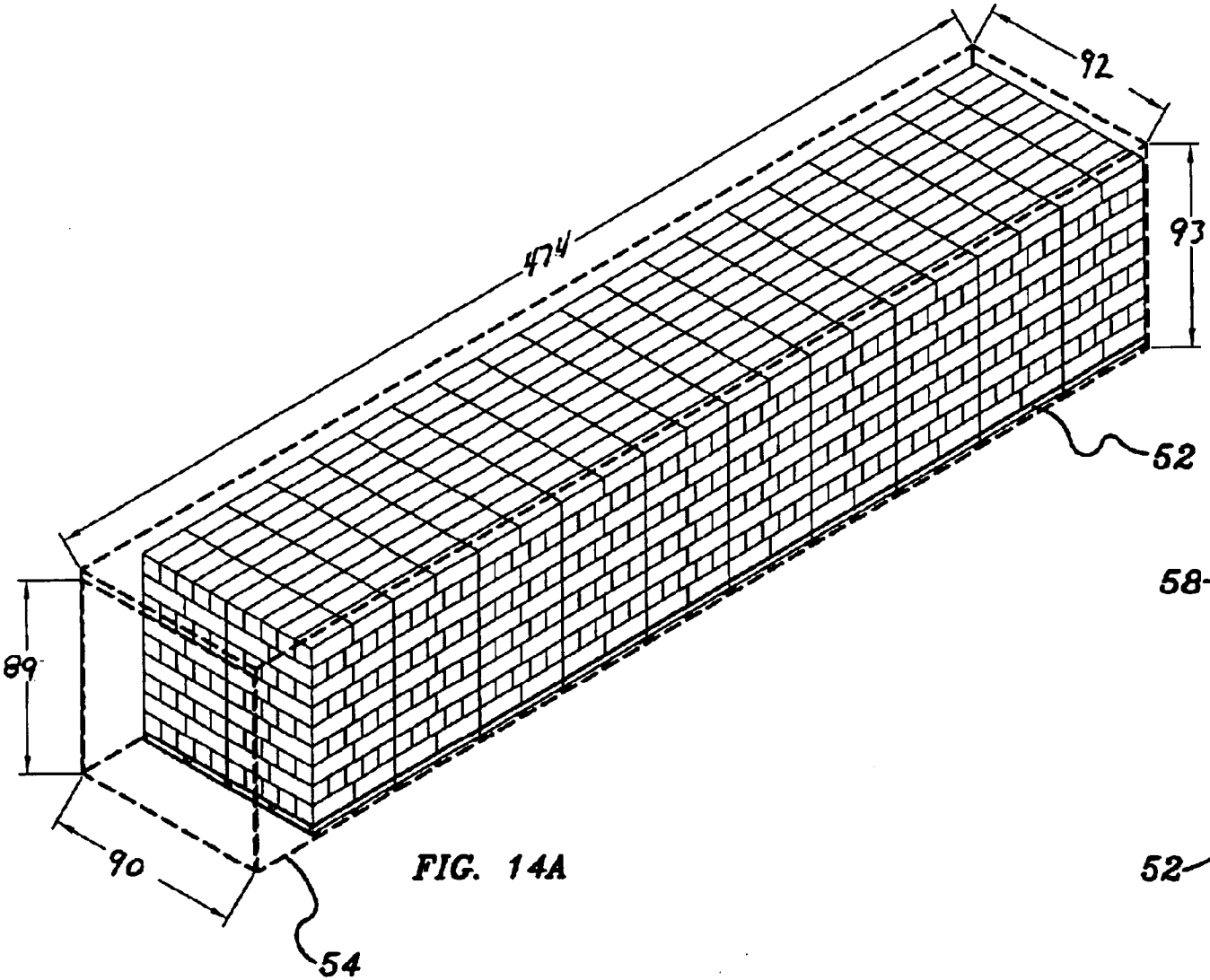
FIGS. 14A–14B are various views of palletizing and transporting home comfort appliances according to an exemplary embodiment of the present invention.
Figure 14B:
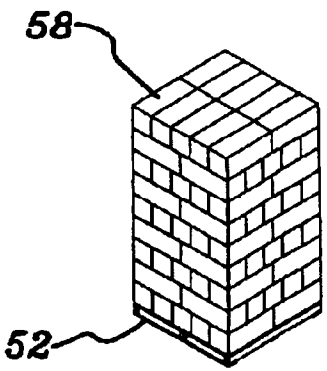

Referring now to FIG. 4C and FIGS. 14A–14B, another advantage of the exemplary design is realized with respect to packaging and shipment. As shown in FIG. 4C, when compared to the prior art pedestal fan and tower fan, packaging of the present invention in container 58 requires much less packaging volume. An attendant advantage is illustrated in FIG. 14B where the number of units per skid 52 increases by over 80% and 100%, respectively, as compared to FIG. 5B and FIG. 6B. Furthermore, the number of units capable of transportation in shipping container 54 as shown in FIG. 14A increases by over 100% and 33%, respectively, as compared to FIG. 5A and FIG. 6A.

Although the invention has been described with reference to exemplary embodiments, it is not limited thereto. Rather, the appended claims should be construed to include other variants and embodiments of the invention, which may be made by those skilled in the art without departing from the true spirit and scope of the present invention.

What is claimed:

1. A home comfort appliance comprising:

a support member having a predetermined rise height R, the support member providing support and elevation; and an elongate housing comprising:

at least one wall portion having a predetermined length L and an air generation envelope D, wherein the length L of elongate housing is oriented substantially vertically;

at least one inlet opening formed in a first portion of the at least one wall portion;

at least one vertically elongate outlet opening formed in a second portion of the at least one wall portion, and;

an air generator disposed within the elongate housing and positioned between the at least one inlet opening and the at least one vertically elongate outlet opening, said air generator inducing inlet air to enter the elongate housing through the inlet opening and providing exhaust air that exits the elongate housing through to the at least one elongate outlet opening, said air generator further comprising:

at least one motor including at least one shaft extension;

at least one blade assembly attached to the shaft extension;

an axis of rotation of the blade assembly oriented in a substantially vertical orientation;

an overall length of the blade assembly measured from a lower vertical extent to an upper vertical extent of the blade assembly along a path substantially parallel to the axis of rotation of the blade assembly;

a support member having a predetermined rise height R measured from the support surface to an opposing elevated end of the column, the support member providing support and elevation to the elongate housing to elevate and support the elongate housing above a support surface, the support member further comprising;

a base contacting the support surface;

a column supported by the base and extending vertically upward relative to the support surface and operatively connected to the elongate housing at the opposing elevated end of the column;

wherein rise height R of the support member and the length L of the elongate housing are utilized to elevate the exhaust air above the support surface, wherein the rise height R is greater than about 39% of length L of the elongate housing.

2. The home comfort appliance according to claim 1, wherein the elongate housing further comprises at least one of;

i) control means for controlling operation of the home comfort appliance, and ii) oscillation means for oscillating the elongate housing with respect to the support member.

3. The home comfort appliance according to claim 1, wherein the support member further comprises a coupling disposed between a lower portion of the elongate housing and an upper portion of the support member, the coupling having a diameter larger than a diameter of the support member.

4. The home comfort appliance according to claim 1, wherein the air generation envelope D is i) less than the diameter B and ii) between about 10% to about 90% of length L, and wherein the rise height R is greater than 39% of length L.

5. The home comfort appliance according to claim 4, wherein the air generation envelope D is less than a predetermined base envelope B.

6. The home comfort appliance according to claim 1, wherein the length L is less than about 68% of the sum of the length L plus the rise height R.

7. The home comfort appliance according to claim 1, wherein the rise height R is greater than about 29% of the sum of length L plus the rise height R.

8. The home comfort appliance according to claim 7, wherein the rise height R is at least about 12 inches.

9. The home comfort appliance according to claim 7, wherein the rise height R is adjustable.

10. The home comfort appliance according to claim 1, wherein an overall length of the elongate housing is less than about 30 inches.

11. The home comfort appliance according to claim 1, wherein an overall length of the elongate housing is between about 15 and about 30 inches.

12. The home comfort appliance according to claim 1, wherein the air generator comprises a motor having a shaft and a blade assembly coupled to the shaft, the blade assembly having an overall length of the blade assembly is no greater than about 45% of an overall length of the home comfort appliance.

13. The home comfort appliance according to claim 1, wherein an overall length of the home comfort appliance is at least about 45 inches.

14. The home comfort appliance according to claim 1, wherein an overall length of the home comfort appliance is between about 45 and about 60 inches.

15. The home comfort appliance according to claim 1, wherein i) an overall length of the home comfort appliance is between about 45 and about 60 inches and ii) an overall length of the elongate housing is between about 15 and about 30 inches.

16. The home comfort appliance according to claim 1, further comprising oscillation means disposed at a lower portion of the elongate housing and coupled between the elongate housing and the support member.

17. The home comfort appliance according to claim 1, further comprising rotation means disposed at a lower portion of the elongate housing and coupled between the elongate housing and the support member.

18. The home comfort appliance according to claim 1, wherein the air generator further comprises a blade assembly, the blade assembly is positioned behind the at least one outlet opening by a predetermined distance greater than about 20% of a diameter of the blade assembly.

19. The home comfort appliance according to claim 1, wherein the base is formed from at least a pair of base portions coupled to one another.

20. The home comfort appliance according to claim 1, wherein the air generator further comprises:

a motor having a shaft, a plurality of blade assemblies coupled to the shaft and spaced apart from one another by a predetermined distance, each of the plurality of blade assemblies comprising a pair of impeller portions formed as a unitary member, and at least one bearing assembly disposed at least one of i) between a pair of the plurality of blade assemblies and ii) adjacent an end one of the plurality of blade assemblies.

21. The home comfort appliance according to claim 1, wherein the air generator at least one motor including at least one shaft extension and at least one blade assembly attached to the shaft extension further comprises a motor having a shaft extending from opposite sides of the motor and a pair of blade assemblies each coupled to respective portions of the shaft, each blade assembly having no greater than two impeller portions formed as a unit and coupled to the respective portion of the shaft.

22. The home comfort appliance according to claim 21, wherein the motor is positioned between the pair of blade assemblies.

23. The home comfort appliance according to claim 1, wherein at least a portion of the exhaust air travels along a path substantially orthogonal to a longitudinal axis of the elongate housing.

24. The home comfort appliance according to claim 1, wherein the at least one elongate outlet opening is a plurality of outlet openings parallel to one another.

25. The home comfort appliance according to claim 1, wherein the home comfort appliance is portable.

26. The home comfort appliance according to claim 1, further comprising means for at least one of i) positioning the elongate housing at one of a plurality of rotational positions, ii) oscillating the elongate housing between a first position and a second position, and iii) rotating the elongate housing about a longitudinal axis.

27. The home comfort appliance according to claim 26, wherein the elongate housing is substantially linear, and an axis of rotation of said elongate housing is coaxial with a longitudinal axis of said support member.

28. The home comfort appliance according to claim 1, wherein the air generator is a blower assembly.

29. The home comfort appliance according to claim 1, further comprising redirecting means for redirecting the exhaust air flowing from the elongate outlet opening.

30. The home comfort appliance according to claim 1, further comprising at least one louver adjacent the at least one elongate outlet opening for redirecting the exhaust air flowing from the elongate outlet opening.

31. The home comfort appliance according to claim 1, further comprising a grill coupled to at least an upper portion of the elongate housing.

32. The home comfort appliance according to claim 1, wherein a height of the elongate housing above a mounting surface is adjustable to one of a plurality of positions.

33. The home comfort appliance according to claim 1, wherein the at least one wall portion is a plurality of wall portions coupled to one another.

34. The home comfort appliance according to claim 1, wherein the at least one wall portion has a substantially circular cross section.

35. The home comfort appliance according to claim 1, wherein the at least one wall portion has a substantially oval cross section.

36. The home comfort appliance according to claim 1, wherein the at least one wall portion has a substantially polygonal cross section.

37. The home comfort appliance according to claim 1, wherein the elongate housing is rotatably coupled to the support member.

38. The home comfort appliance according to claim 1, wherein the exhaust air further comprises a vertical column of exhaust air having a length oriented substantially vertically and a width oriented substantially horizontally, the vertical column of exhaust air having an upper extent proximate a top of the elongate housing and a lower extent proximate a bottom of the elongate housing, the column of exhaust air having a length to width ratio of at least 2 to 1, wherein the column of exhaust air substantially conforms to an upper body portion of a user.

39. A home comfort appliance comprising:

a support member having a predetermined maximum width and a predetermined minimum rise height R, the support member providing support and elevation; and a an elongate housing fixedly operatively coupled to an a top end of the support member and comprising:

at least one wall portion having a predetermined length L, a width, and an air generation envelope D, the length of the elongate housing being oriented substantially vertical, the elongate housing having a length to width ratio of at least 2 to 1, at least one inlet opening formed in a first portion of the at least one wall portion elongate housing, at least one elongate outlet opening formed in a second portion of the at least one wall portion elongate housing, the at least one elongate outlet opening having a length and a width wherein the length of the at least one elongate outlet opening is substantially aligned with the length of the elongate housing, the at least one elongate outlet opening having a length to width ratio of at least 2 to 1, and an air generator positioned in the elongate housing between the at least one inlet opening and the at least one elongate outlet opening, and providing exhaust air to the at least one elongate outlet opening;

wherein the air generation envelope D is i) less than the support member maximum width and ii) between 10% to 90% of length L of the elongate housing; and wherein the minimum rise height R is greater than 39% of length L of the elongate housing.

40. The home comfort appliance according to claim 39, wherein the support member comprises a base and a columnar riser.

41. The home comfort appliance according to claim 39, wherein the elongate housing further comprises at least one of:

i) control means for controlling operation of the home comfort appliance, and ii) oscillation means for oscillating the elongate housing.

42. The home comfort appliance according to claim 39, wherein the support further comprises a coupling disposed between a lower portion of the elongate housing and an upper portion of the support, the coupling having a diameter larger than a diameter of the support.

43. The home comfort appliance according to claim 39, wherein the length L is less than 68% of the sum of the length L plus the rise height R.

44. The home comfort appliance according to claim 39, wherein the rise height R is greater than 29% of the sum of length L plus the rise height R.

45. The home comfort appliance according to claim 44, wherein the rise height R is at least 12 inches.

46. The home comfort appliance according to claim 44, wherein the rise height R is adjustable.

47. The home comfort appliance according to claim 39, wherein an overall length of the elongate housing is less than 30 inches.

48. The home comfort appliance according to claim 39, wherein an overall length of the elongate housing is between about 15 and 30 inches.

49. The home comfort appliance according to claim 39, wherein the air generator comprises a motor having a shaft and a blade assembly coupled to the shaft, the blade assembly having an overall length no greater than 45% of an overall length of the home comfort appliance.

50. The home comfort appliance according to claim 39, wherein an overall length of the home comfort appliance is at least 45 inches.

51. The home comfort appliance according to claim 39, wherein an overall length of the home comfort appliance is between about 45 and 60 inches.

52. The home comfort appliance according to claim 39, wherein i) an overall length of the home comfort appliance is between about 45 and 60 inches and ii) an overall length of the elongate housing is between about 15 and 30 inches.

53. The home comfort appliance according to claim 39, wherein the air generation envelope D is less than a predetermined base envelope B said predetermined maximum width of said support member.

54. A home comfort appliance comprising:

support means for providing support and elevation, the support means having a predetermined base envelope B and a predetermined rise height R, wherein the rise height R is at least about 12 inches; and elongate housing means coupled to one end of the support means and extending substantially vertically from the support means, the elongate housing means comprising:

wall means having a predetermined length L and a predetermined air generation envelope D, wherein the predetermined length L of the wall means is less than about 30 inches and the predetermined air generation envelope D is less than the predetermined base envelope B, inlet means formed in a first portion of the at least one wall portion, outlet means formed in a second portion of the at least one wall portion, and air generation means positioned between the inlet means and the outlet means, for providing exhaust air to the outlet means;

wherein an overall length of the home comfort appliance is at least about 45 inches; and wherein the combination of the rise height R of the support member and the length L of the elongate housing elevate the exhaust air above the support surface to more immediately effect an upper body portion of a user.

55. The home comfort appliance according to claim 54, wherein the support means comprises a base and a columnar riser.

56. The home comfort appliance according to claim 54, wherein the elongate housing means further comprises at least one of:

i) control means for controlling operation of the home comfort appliance, and ii) oscillation means for oscillating the elongate housing with respect to the support member.

57. The home comfort appliance according to claim 54, wherein the support means comprises a coupling disposed between a lower portion of the elongated housing means and an upper portion of the support means, the coupling having a diameter larger than a diameter of the support means.

58. The home comfort appliance according to claim 54, wherein the air generation envelope D is between 10% to 90% of length L, and wherein the rise height R is greater than 39% of length L.

59. The home comfort appliance according to claim 54, wherein the length L is less than 68% of the sum of the length L plus the rise height R.

60. The home comfort appliance according to claim 54, wherein the rise height R is greater than 29% of the sum of length L plus the rise height R.

61. The home comfort appliance according to claim 54, wherein the rise height R is adjustable.

62. The home comfort appliance according to claim 54, wherein an overall length of the elongate housing means is between about 15 and 30 inches.

63. The home comfort appliance according to claim 54, wherein the air generation means comprises a motor having a shaft and a blade assembly coupled to the shaft, the blade assembly having an overall length no greater than 45% of an overall length of the home comfort appliance.

64. The home comfort appliance according to claim 54, wherein an overall length of the home comfort appliance is between about 45 and 60 inches.

65. The home comfort appliance according to claim 54, wherein i) an overall length of the home comfort appliance is between about 45 and 60 inches and ii) an overall length of the elongate housing means is between about 15 and 30 inches.

66. The home comfort appliance according to claim 54, wherein the support means includes a base portion having at least one of substantially circular cross section, a substantially oval cross section, and a substantially polygonal cross section.

* * * * *

UNITED STATES PATENT AND TRADEMARK OFFICE

CERTIFICATE OF CORRECTION

PATENT NO. : 6,942,456 B2
DATED : September 13, 2005
INVENTOR(S) : Barry Shapiro It is certified that error appears in the above-identified patent and that said Letters Patent is hereby corrected as shown below:

Column 11,
Line 5, delete the first instance of "a".

Signed and Sealed this

Twenty-fourth Day of January, 2006

JON W. DUDAS
*Director of the United States Patent and Trademark Office*

UNITED STATES PATENT AND TRADEMARK OFFICE

CERTIFICATE OF CORRECTION

PATENT NO. : 6,942,456 B2
APPLICATION NO. : 10/431964
DATED : September 13, 2005
INVENTOR(S) : Barry Shapiro It is certified that error appears in the above-identified patent and that said Letters Patent is hereby corrected as shown below:

Column 8, Lines 3-5 (Claim 1) – Please delete the following: "a support member having a predetermined rise height R, the support member providing support and elevation; and"

Signed and Sealed this

Tenth Day of April, 2007

JON W. DUDAS
*Director of the United States Patent and Trademark Office*